US009339921B2

(12) United States Patent
Bussone et al.

(10) Patent No.: US 9,339,921 B2
(45) Date of Patent: May 17, 2016

(54) DRIVESHAFT REMOVAL TOOL WITH ANGLED TIP

(71) Applicant: FORD GLOBAL TECHNOLOGIES, LLC, Dearborn, MI (US)

(72) Inventors: Robert Bussone, Almont, MI (US); Gregory Lutz, Oxford, MI (US); Joseph Kinney, Columbus, MI (US); Timothy Zacharias, St. Clair, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 235 days.

(21) Appl. No.: 14/087,003

(22) Filed: Nov. 22, 2013

(65) Prior Publication Data

US 2015/0143681 A1 May 28, 2015

(51) Int. Cl.
*B25B 27/14* (2006.01)
*B25B 27/04* (2006.01)

(52) U.S. Cl.
CPC ..... *B25B 27/04* (2013.01); *Y10T 29/5393* (2015.01)

(58) Field of Classification Search
CPC ..... B05B 1/00; B05B 3/00; B05B 7/00; B05B 9/00; B05B 13/00; B25B 27/04
See application file for complete search history.

(56) References Cited

U.S. PATENT DOCUMENTS

| | | | | |
|---|---|---|---|---|
| 5,782,149 | A * | 7/1998 | Jensen | 81/125 |
| 6,105,190 | A * | 8/2000 | Shiao | 7/165 |
| 7,021,164 | B2 * | 4/2006 | Fenkanyn | 73/866.5 |
| 7,255,028 | B1 * | 8/2007 | Di Bitonto et al. | 81/439 |
| 8,376,678 | B2 * | 2/2013 | Walker | 411/387.1 |
| 2011/0146043 | A1 * | 6/2011 | Canal Rivera et al. | 29/221.6 |

* cited by examiner

*Primary Examiner* — Shelley Self
*Assistant Examiner* — Nirvana Deonauth
(74) *Attorney, Agent, or Firm* — Joseph E. Root

(57) ABSTRACT

A tool for removing a first shaft from a second shaft, in which the first and the second shafts are coupled by fasteners. The tool generally includes the flanged connection and a driving rod. One or more apertures extend completely through a first portion extend into the second flange portion a distance less than the thickness of the second flange portion. The driving rod has first and second ends, with a removable cap adapted to engage the second end to provide a striking surface. At least one removable driver tip is also provided, having a connecting end adapted to engage the first end, and a driver tip, sized to fit into the aperture and extending outward from the connecting end. The driver tip is angled such that the second end of the driving rod is accessible when the driver tip is inserted into the aperture.

5 Claims, 2 Drawing Sheets

DRIVESHAFT REMOVAL TOOL WITH ANGLED TIP

TECHNICAL FIELD

Embodiments of the present disclosure generally relate to automotive tools, and, more particularly, to a tool for maintenance activities on an automotive power train.

BACKGROUND

Driveshafts, also referred to as propeller shafts, are employed in vehicles to transfer rotary motion to the wheels. In general, a driveshaft couples to the vehicle transmission on one end via a power take off unit (PTU), and to a differential gear assembly on the other end. Universal joints generally form couplings at both ends. The resulting arrangement facilitates energy transfer from the engine to the wheels.

In keeping with contemporary engineering practice of reducing weight and thickness of components, the end caps on driveshaft universal joints and the PTU are now fashioned from thinner and lighter gauge materials than formerly. These components are relatively lower in stiffness as well. The newer materials do reduce vehicle weight, but they can also pose difficulties for maintenance personnel in working with these components without damaging them.

Service operations that require removing the driveshaft generally require traditional dis-assembling techniques. One such technique involves the well-known method of separating the yoke ends, typically by prying them. Often, however, this technique irreversibly damages the end caps. Corrosion, which has the effect of requiring increased force to separate the yoke ends, along with the incorporation of lighter gauge material, increases the risk of damage and deformation.

Thus, the art stands in need of improved tools for removing a driveshaft from a vehicle with minimum risk of damage. No current practice addresses this difficulty encountered during service and repairs.

SUMMARY

One aspect of the present disclosure describes a tool for removing a first shaft from a second shaft, in which the first and the second shafts are coupled by at least one fastener element extending through a flanged connection formed on the first and second shafts. The tool generally includes the flanged connection and a driving rod. The flanged connection includes one or more apertures, each aperture extending completely through a first shaft flanged connection portion and extending into the second shaft flanged connection a distance less than the thickness of the second shaft flanged connection. The driving rod has a first end, including a first connection arrangement, and a second end, including a second connection arrangement. In addition, a removable cap is adapted to engage the second connection arrangement, the cap fitting over the driving rod and having a striking surface. At least one removable driver tip is also provide, having a connecting end adapted to engage the first connection arrangement and a driver tip, sized to fit into the aperture and extending outward from the connecting end. The driver tip is angled such that the second end of the driving rod is accessible when the driver tip is inserted into the aperture.

Additional aspects, advantages, features and objects of the present disclosure would be made apparent from the drawings and the detailed description of the illustrative embodiments construed in conjunction with the appended claims that follow.

BRIEF DESCRIPTION OF THE DRAWINGS

The figures described below illustrate a number of exemplary embodiments of the disclosure. Throughout the drawings, like reference numerals refer to identical or functionally similar elements. The drawings are illustrative in nature and are not drawn to scale.

DETAILED DESCRIPTION

The following detailed description is made with reference to the figures. Exemplary embodiments are described to illustrate the subject matter of the disclosure, not to limit its scope, which is defined by the appended claims.

Overview

In general, the present disclosure describes an apparatus for removing a driveshaft from a Power Take off Unit (PTU) in a vehicle. This disclosure addresses a driveshaft removal tool having an angled driver tip insertable into an access aperture, formed in an end cap flange. The end cap flange is attached to a flange on the driveshaft. Once the punch tip is inserted into an access aperture, repeated taps on the driving cap pushes against the driveshaft flange, thereby separating the driveshaft from the PTU output shaft. This operation advantageously removes the driveshaft while producing only limited or substantially negligible damage to the driveshaft end caps.

Exemplary embodiments

The following detailed description illustrates aspects of the disclosure and its implementation. This description should not be understood as defining or limiting the scope of the present disclosure, however, such definition or limitation being solely contained in the claims appended hereto. Although the best mode of carrying out the invention has been disclosed, those in the art would recognize that other embodiments for carrying out or practicing the invention are also possible.

Figure 1A:
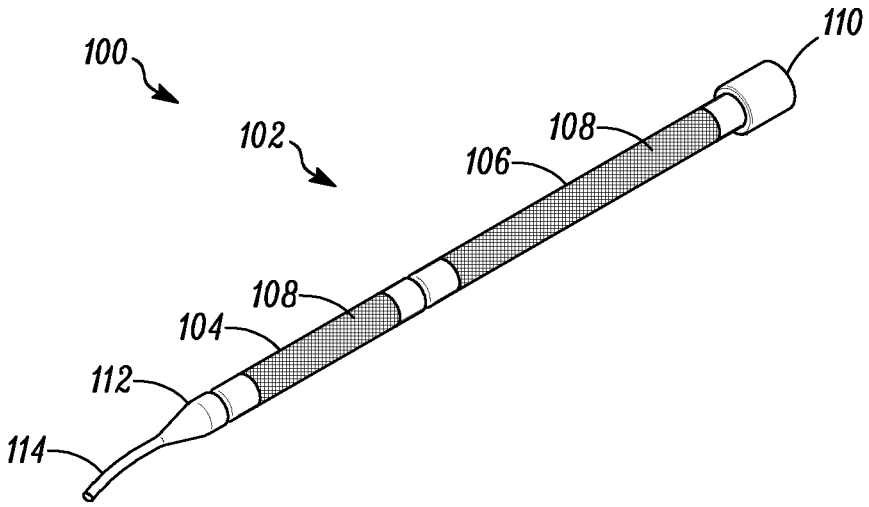
FIG. 1A is a pictorial view of an exemplary driveshaft removal tool according to the aspects of the present disclosure.
Figure 1B:
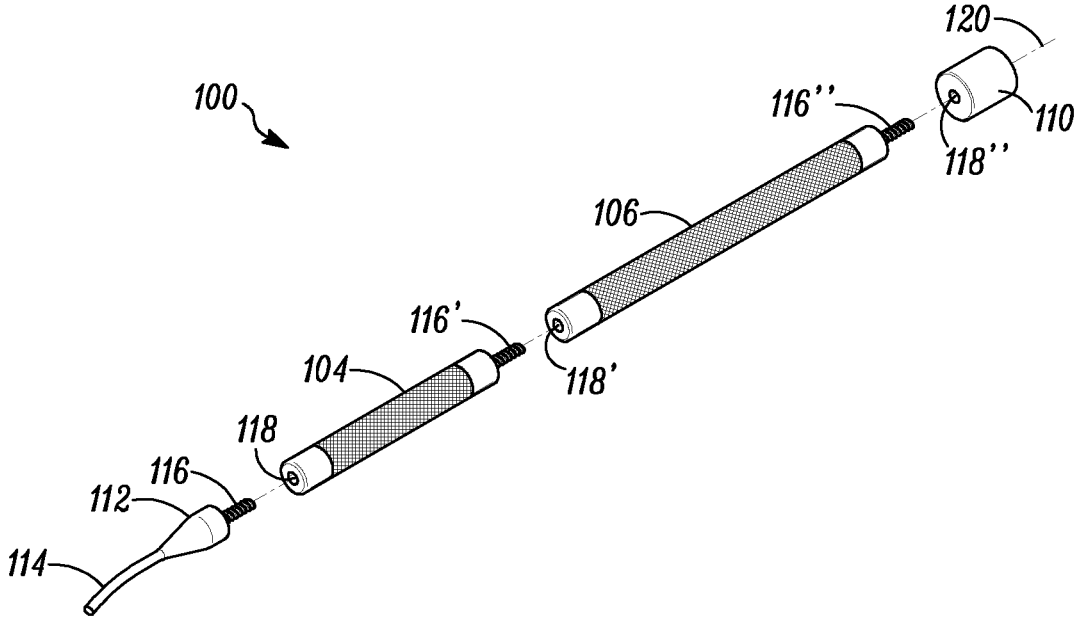
FIG. 1B is an exploded view of the driveshaft removal tool of FIG. 1A.

FIGS. 1A and 1B illustrate an exemplary driveshaft removal tool 100 according to the present disclosure. FIG. 1A presents an assembled view, and FIG. 1B depicts an exploded view. Portions that facilitate the tool's assembly, therefore, can be visualized more clearly in FIG. 1B. The driveshaft removal tool 100 includes a driving rod 102, in the form of an extended rod. A driving cap 110 is fitted to one end of driving rod 102, and a removable tip 112 is carried at its opposite end.

In the illustrated embodiment, the driving rod 102 has a circular cross-section, but other forms can be employed, based upon the needs of the particular tool. Also, the illustrated embodiment includes a base member 106 and an extension member 104. These members are structurally similar and connect to form an integrated driving rod 102. A knurled portion 108 may be provided to offer an improved gripping surface.

In one embodiment, the length of the extension member is 9 inches, while the base member measures 16 inches. The exact dimensions, and the combination of dimensions, can be chosen to fit a particular automotive vehicle or series of automotive vehicles.

One end of both extension member 104 and base member 1064 provide threaded recesses 118,118', and the opposite end of each rod carries a threaded stud 116', 116". Using these elements, the two rods can be screwed together to form driving rod 102. This configuration provides three tool lengths, including a short length, employing extension member 104; a medium length, employing base member 106; and a long length, employing driving rod 102. A user can select the length most suitable for a particular job. Further, lengths of each member may be chosen with an eye to providing the most useful lengths, based on the expected vehicles to be serviced. Moreover, although three possible combinations are illustrated in the depicted embodiment, it will be clear to those in the art that any number of different lengths can be made available to a user, based on anticipated requirements. If only a single vehicle is to be serviced, of course, a single driving rod 102, fashioned to the appropriate length, could be provided.

Structurally, the extension and base members 104,106 include a solid steel body, which may be formed by machining or similar manufacturing processes. Although a threaded connection between the extension member 104 and the base member 106 is illustrated, other connection types, such as, luer-locks, snap fits, and the like, may be employed. In the illustrated embodiment, both members 104 and 106 are substantially cylindrical in cross-section, but those in the art may envision other suitable shapes and configurations.

A driver tip 112 is carried on an end of the driving rod 102. In the depicted embodiment, the driver tip 112 includes a stud 116 that can threadably assemble into the recess 118 of the extension member 104 or into recess 118' of base rod 106. When so assembled, driver tip 112 extends outward from the extension member 104. In form, this element tapers from the diameter of extension member 104 to a punch tip 114. In some embodiments, punch tip 114 will form the major portion of the length of driver tip 112, and that element will generally be formed with a circular cross-section having a smaller diameter than that of extension member 104, as explained below. Particular dimensions and forms can be altered to fit particular scenarios.

Punch tip 114 bends or curves, forming an angle to the driving rod longitudinal axis 120. The purpose and employment of this angle is described below in connection with FIGS. 2A and 2B. Alterations to this design are possible based on individual requirements and practices. Thus, additional curvatures, extension trims, bends, flexures, etc., may be contemplated. In an exemplary embodiment, the bend angle lies in the range of 0°-30°. In some applications, the maximum bend angle may be restricted to about 20° to assure delivery of optimum force without bending the driver tip. Further alterations to this design will be detailed below.

The opposite end of driving rod 102, (i.e., the end of base member 106 not threadably engaging extension member 104), carries a driving cap 110. A stud 116, formed in an end of base member 106, as discussed below, threadably attaches the driving cap 110 to the base member 106. Driving cap 110 generally continues the form of base member 106, and in some embodiments it may have a greater diameter than the latter element. This cap provides a surface for tapping with a hammer or other suitable striking object, for transferring a longitudinal force without damaging the threads of either extension member 104 or base member 106. Also, driving cap 110 has a suitable thickness that will stand up under repeated hammer blows.

Figure 2A:
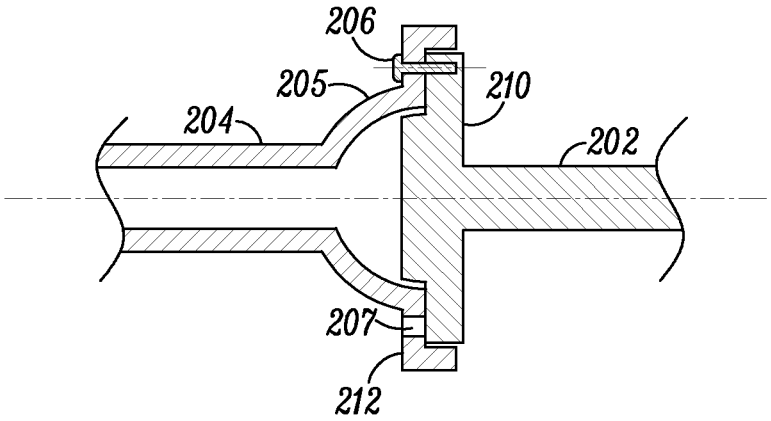
FIG. 2A, 2B, and 2C, are cross-sectional views of the driveshaft removal tool in an exemplary application.
Figure 2B:
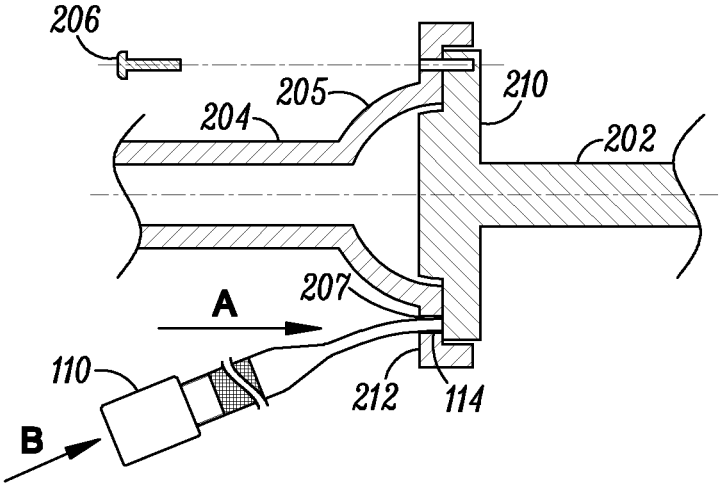
Figure 2C:
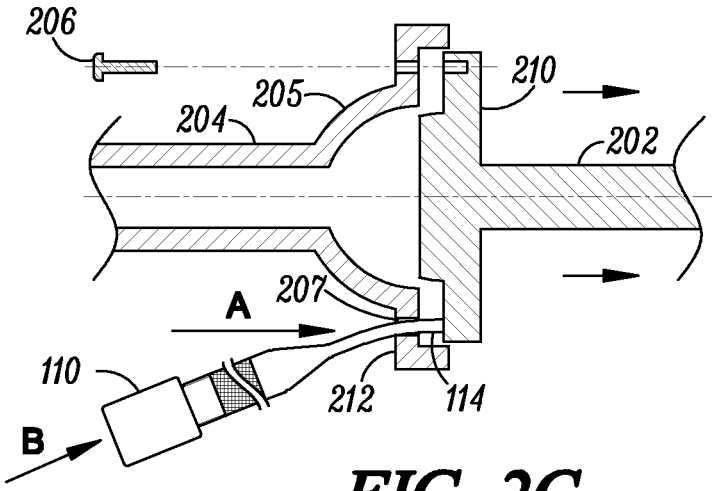

FIGS. 2A, 2B, and 2C illustrate an exemplary employment of the driveshaft removal tool 100. Here, a driveshaft 202 is connected to a PTU end cap 205, located at the end of PTU output shaft 204. Generally, the driveshaft 202 connects the vehicle powertrain to the wheels and is positioned in the vehicle underbody. It will be understood by those in the art that a gear assembly, such as a universal gear or similar device, is carried within end cap 205. Selection of the particular device employed is not relevant to the present disclosure, and thus that device has been omitted from the drawings and will not be discussed further. Both the driveshaft 202 and end cap 205 have generally matching flanges 212, 210, respectively, except that end cap flange 212 is formed with both a flat portion and a lip portion, with the lip portion fitting over the sides of driveshaft flange 210. The flat portions of both flanges are aligned, and the flanges are secured in position by bolts 206. In the illustrated embodiment, six bolts 206 are provided, threadably engaged into tapped recesses in the mating surface of driveshaft flange 210. It will be understood that fewer or more than six bolts may be employed in particular embodiments, as desired. In addition to apertures to accommodate the bolts, two access apertures 207 formed through end cap flange 212, as explained below. Two access apertures are provided in the illustrated embodiment, spaced around the periphery of end cap flange 212.

FIG. 2A depicts a generic layout of the driveshaft 202 coupled to the PTU output shaft 204 via end cap 205. Services and repairs requiring driveshaft removal require the driveshaft's total disengagement from the PTU output shaft 204. Accordingly, FIG. 2B depicts an initial driveshaft disengagement stage, where an operator removes bolts 206, thereby freeing driveshaft flange 210. Typically, however, driveshaft flange 210 and end cap flange 212 adhere to one another, as a result of corrosion or simple buildup of contaminants around the flange joint. This increased friction requires additional measures to separate these two elements. That separation is accomplished with driveshaft removal tool 100. I Initially, a user must configure the various items included with driveshaft removal tool 100 to assemble a tool suitable for use in a particular situation. To accomplish that goal, a user must determine the length required to extend from the PTU/driveshaft junction to a position where a user can employ the driveshaft removal tool. Determining that length allows a user to select the appropriate combination of base member 106 and extension member 104 to form an appropriate driving rod 102. Additionally, a user must determine an appropriate angle for punch tip 114, leading to the selection of the most useful of the specific punch tips 114 available to the user. The user then assembles the selected punch tip 114, the selected combination of base member 106 and extension member 104, together with driving cap 110, to form an appropriate driveshaft removal tool 100.

Then, an operator inserts the punch tip 114 into an available access aperture 207. The end of punch tip 114 bottoms against the surface of end cap 210. The user then taps driving cap 110 with a hammer or other suitable tool, in direction B, which delivers a force to driveshaft flange 210 in direction A. If end cap flange 212 and driveshaft flange 210 are tightly adhered, a number of taps may be required, delivered at access apertures 207 around the periphery of end cap flange 212. Eventually, however, this process will produce the desired separation of driveshaft 202 from the (PTU output shaft 204. Service and repair operations can then commence.

In some embodiments, access aperture 207 may extend into driveshaft flange 210. To effectively remove the driveshaft, of course, there must be some structure provided to absorb the force delivered by punch tip 114. That structure could be provided by having access aperture 207 extend only part way through driveshaft flange 210. In embodiments where it is deemed expedient to extend access aperture 207 completely through driveshaft flange 210, some other structure, such as a welded ear or the like, could be provided, and punch tip 114 would then be able to deliver force to that structure.

Driveshaft removal rod 100 may be delivered to a user as a modular unit, or kit that is portable, incorporating ease of use. For example, such a kit can include multiple driver tips, each having a punch tip 114 structured with different angular bends and lengths. Also, such kits may include variations in the number of members that jointly make the driving rod 102. When accompanied by instruments such as torches, fixtures, hammers, slide hammers, etc., the kit's usability may be enhanced. Additionally, a carrying case may facilitate the kit's portability.

The disclosed driveshaft removal tool 100 may be applied to a variety of other applications. For example, any similar application, requiring the removal of a first shaft from a second may make use of the disclosed subject matter. Applications, however, need not be limited to the separation of shafts alone. Therefore, it may be well known to those in the art that the description of the present disclosure may be applicable to a variety of other environments as well, and thus, the environment disclosed here must be viewed as being purely exemplary in nature.

Further, the tool 100 discussed so far is not limited to the disclosed embodiments alone, as those skilled in the art may ascertain multiple embodiments, variations, and alterations, to what has been described. Accordingly, none of the embodiments disclosed herein need to be viewed as being strictly restricted to the structure, configuration, and arrangement alone. Moreover, certain components described in the application may function independently of each other as well, and thus none of the implementations needs to be seen as limiting in any way.

Accordingly, those skilled in the art will understand that variations in these embodiments will naturally occur in the course of embodying the subject matter of the disclosure in specific implementations and environments. It will further be understood that such variations will fall within the scope of the disclosure. Neither those possible variations nor the specific examples disclosed above are set out to limit the scope of the disclosure. Rather, the scope of claimed subject matter is defined solely by the claims set out below.

We claim:

1. A tool for removing a first shaft from a second shaft, wherein the first and the second shafts are coupled by at least one fastener element extending through a flanged connection formed on the first and second shafts, the tool comprising: one or more apertures formed in the flanged connection, each aperture extending completely through a first shaft flanged connection portion and extending into the second shaft flanged connection a distance less than the thickness of the second shaft flanged connection; a driving rod having a first end, including a first connection arrangement, and a second end, including a second connection arrangement; the driving rod including, an extension member having two ends, a first end having a threaded recess formed therein, and a second end including a connection component; and a base member having two ends, a first end having a threaded recess formed therein, and the second end including a connection component; wherein the threaded recesses on the extension member and the base member form connection arrangements, and the extension member is longer than the base member, a removable cap adapted to engage the second connection arrangement, the cap fitting over the driving rod and having a striking surface; and at least one removable driver tip having a connecting end adapted to engage the first connection arrangement, and a driver tip, sized to fit into the aperture and extending outward from the connecting end; wherein the driver tip is angled such that the second end of the driving rod is accessible when the driver tip is inserted into the aperture.

2. The tool of claim 1, wherein both the extension member and the base member are threadably connected to each other along their longitudinal axis.

3. The tool of claim 1, wherein the connection component is a threaded stud.

4. The tool of claim 1, wherein the driver tip and the removable cap are connected to the driving rod by threaded studs structured thereof.

5. The tool of claim 1, wherein the driver tip extension's angular bend ranges from 0°-30°.

* * * * *